US006126553A

United States Patent [19]

Lakusiewicz

[11] Patent Number: 6,126,553

[45] Date of Patent: Oct. 3, 2000

[54] BOWLING BALL FINGER INSERTS

[76] Inventor: Ronald J. Lakusiewicz, 1316 Euel Rd., Poplar Bluff, Mo. 63901

[21] Appl. No.: 09/258,480

[22] Filed: Feb. 26, 1999

[51] Int. Cl.[7] ..... A63B 37/00

[52] U.S. Cl. ..... 473/130; 473/129

[58] Field of Search ..... 425/2; 264/222, 264/DIG. 30; 473/127, 128, 129, 130

[56] References Cited

U.S. PATENT DOCUMENTS

| | | |
|---|---|---|
| 533,011 | 1/1895 | Huntoon . |
| 626,584 | 6/1899 | Wilmerling . |
| 4,247,102 | 1/1981 | Seyler . |
| 4,289,312 | 9/1981 | Heimbigner . |
| 4,358,112 | 11/1982 | Straborny . |
| 4,416,452 | 11/1983 | Heimbigner . |
| 4,623,149 | 11/1986 | Herman . |
| 4,699,380 | 10/1987 | Mace . |
| 4,773,645 | 9/1988 | Todd et al. . |
| 4,968,033 | 11/1990 | Aluotto . |
| 5,118,106 | 6/1992 | Goldman . |
| 5,308,061 | 5/1994 | Bernhardt . |
| 5,330,392 | 7/1994 | Bresin . |
| 5,498,209 | 3/1996 | Arutunian . |

OTHER PUBLICATIONS

Publication : Bowlers Journal International Jul. 1998 Vise-Grip—Advertisement p. 29.

Publication : Bowlers Journal International May, 1998 Grip Masters—Advertisement p. S–14.

Publication : Bowlers Journal International May, 1998 Thumb Thing—Advertisement p. 51.

Publication : Bowlers Digest Jul., 1995 Turbo 2–N–1 Grips—Advertisement p. 15.

Publication : Bowlers Journal International May, 1998 Thumbs Up Thumb Straight—Advertisement p. 86.

Publication : Bowlers Journal International Jul., 1998 Contour Power Grips—Advertisement p. 24.

Publication : Bowlers Journal International Jul., 1998 Tenth Frame Products—Advertisement p. 5.

*Primary Examiner*—William M. Pierce

*Attorney, Agent, or Firm*—Blackwell Sanders Peper Martin

[57] ABSTRACT

A customized, anatomically correct insert for a bowling ball includes a main body portion having a first end and a second end. An outer portion has a first end and a second end, the first end being flush with the surface of a bowling ball with which the insert is intended to be used, when in normal use position, and the second end being connected to the first end of the main body portion of the insert. The outer portion of the insert is positioned at the mouth of a bowling ball hole when the insert is in normal use position in the bowling ball hole and has a greatest external dimension substantially equal to the internal dimension of the bowling ball hole, so as to be capable of being press-fit into the bowling ball hole, yet not being so large as to be subject to becoming so tightly stuck within the bowling ball hole that it cannot be selectively removed by the bowler. The main body portion has an outer side wall with a greatest external dimension which is less than the greatest external dimension of the generally outer portion, so that an air space remains between the outer side wall of the central portion and the wall defining the bowling ball hole, and the main body portion and the outer portion have formed therein an anatomically correct cavity for receiving a finger of a bowler for whom the insert is custom-made.

36 Claims, 4 Drawing Sheets

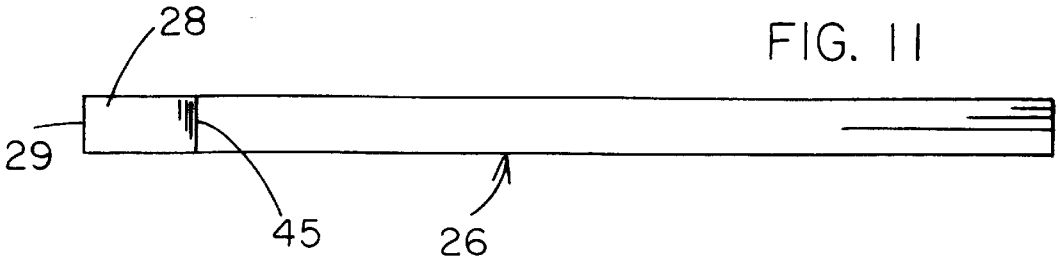
FIG. 11
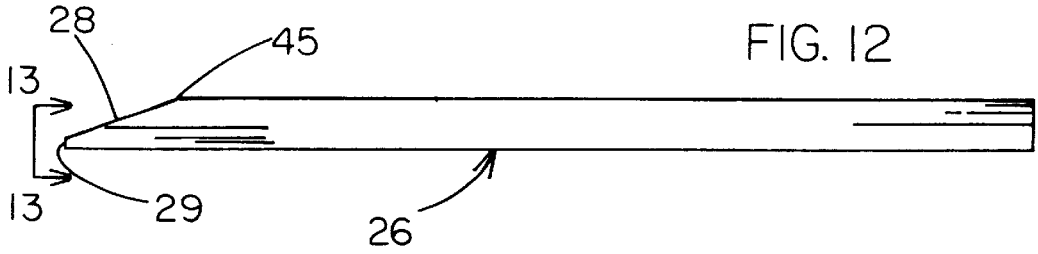
FIG. 12
FIG. 13
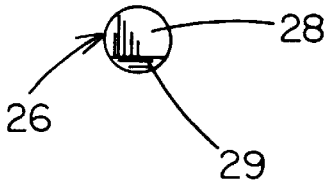
FIG. 14
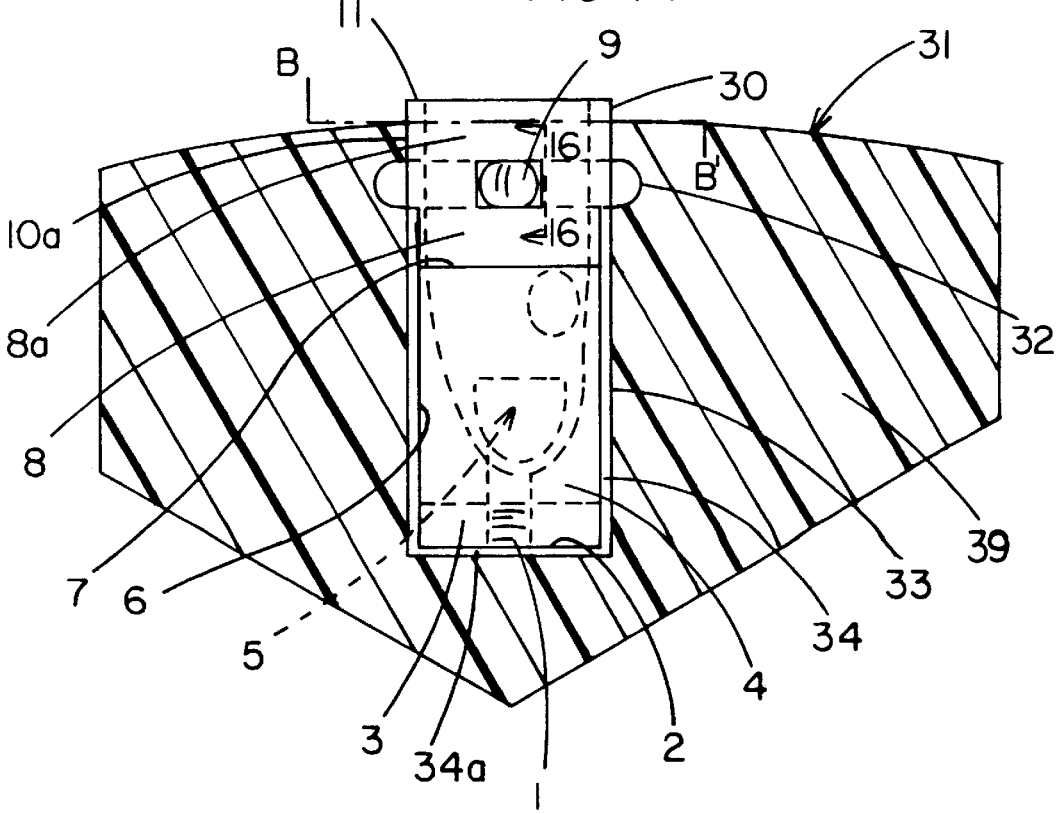

BOWLING BALL FINGER INSERTS

BACKGROUND OF INVENTION

1. Field of Invention

The invention pertains, generally, to inserts that are placed in the pre-drilled holes of a bowling ball, and, more specifically to custom made inserts represented by a plurality of different sizes of the exact anatomical configuration of a finger or thumb of a specific bowler, which inserts can be easily interchanged one for the other, and which self-lock into the bowling ball hole of one or more bowling balls without necessity of adhesives.

2. Description of Related Art

It is a chronic problem for bowlers, and especially professional bowlers, that during the course of a game the size of a bowler's digits changes, causing the fingers or thumb to not fit properly in the respective bowling ball hole. Most commonly the digits swell over the course of a game, or several games. Sometimes, however the bowler's digits may shrink from their average size. For example, if upon beginning a game the room is somewhat cool, or the bowler is nervous, the digits may be somewhat reduced from their normal diameter, but over the course of usage, the fingers (and/or thumb) then increase in diameter. Throughout this document it will be noted that the word "finger" may be used in a general manner which is intended to include the thumb; i.e. as the equivalent of "digit".

As is well known to those versed in the state of the art, the solution to the problems of finger swelling and shrinkage and the proper fitting of fingers into both pre-drilled holes in bowling balls and inserts placed into those holes to aid the action of gripping the ball has been elusive. Resolution of the problem of finger size changes is the primary issue facing all makers of bowling ball finger inserts today because, in spite of the number of insert products available for improving the action of grip of a bowling ball, none of the known alternatives adequately address the problem of finger size changes.

There are a number of reasons for this lack of complete solution, including: that the swelling and shrinkage that take place are irregular and constantly changing, the swelling and shrinkage are temperature related, the digit size is related to the degree of use, the change in finger size is bi-directional, being both expansile and contractile, and the size changes take place in a rigidly confined area with a rigid non-anatomical perimeter represented by a circle or oval configuration; i.e., the interior side wall of the bowling ball finger or thumb hole. Further adding to the difficulty are the facts that the swelling is related to the specific body characteristics and the physiology of individual bowlers (e.g. some people retain more fluids in their systems and some people sweat more than others), and known inserts are firmly fixed (often permanently) into the ball by an adhesive or some sort of screw mechanism so that if there is a great size change in the bowler's digits a completely different ball with different sized inserts may be required.

Some patented attempts at a solution to the problem of bowler's finger swelling and shrinkage have been made and examples thereof are discussed below:

Todd and Hibler (U.S. Pat. No. 4,773,645) illustrate finger inserts glued into a bowling ball. The inserts are circular at the finger interface, having two different diameter sizes for the same insert individual piece, multiple "ribbings" to aid fixation.

Bresin and Thielen (U.S. Pat. No. 5,330,392) also disclose finger inserts that are circular at their interfaces with the corresponding digits and control swelling through the use of multiple, external fluted grooves on the external surface of the insert, the inserts being glued in place in the bowling ball and thus not being interchangeable.

Arutunian (U.S. Pat. No. 5,498,209) discloses a composite bowling ball insert as an attempt to automatically control finger swelling. The insert has two coaxially aligned cylinders with a circular shaped finger/insert interface and an air space separating the two cylinders. The Arutunian inserts are glued in place in the bowling ball holes.

Seyler (U.S. Pat. No. 4,247,102) shows a circular finger interface cylinder screwed into the bottom of the bowling ball hole and fixed with a tapered wedge screw, the insert being removable by use of a spanner wrench tool.

Aluotto (U.S. Pat. No. 4,968,033) discloses a construct of three concentric, nested, cup-like, circular receptacles, screw fixated into the bottom of the bowling ball hole.

The above examples of the known art all encompass structural features that are different from the present invention. Those features are best summarized as follows:

All of the above require a circular or oval shaped cavity within the insert to interface with the finger or thumb. This means that a human anatomical form must conform to a non-anatomical shape in order to fit into the insert. However, in reality, when the finger swells, it does not naturally expand uniformly as a circle or an oval because restraining ligaments force the finger shape to change non-uniformly and disproportionately, but always in the planar template (the normal general shape) of the normal, non-swollen individual finger of the individual bowler. This is definitely not a case of "one shape fits all", rather, with the previously described conventional inserts, one shape fits no one.

Accordingly, in order to address the above limitations in the art, the present invention is provided with an anatomically configured internal cavity that is custom shaped exactly to the precise anatomical form of each individual bowling finger of each individual bowler. Further, multiple sizes of this precise anatomical form (both larger and smaller) are presented that accept either expansion or contraction of the finger (which can be naturally expanded or contracted within the limitations of the natural anatomy, such as ligaments). Further, fixation of all known bowling ball finger hole inserts has conventionally been either by an adhesive or glue; or some variation of screw fixation to the bottom of the pre-drilled hole of the bowling ball, making the known inserts very difficult and often impossible to remove from a particular ball without destroying the insert. Thus, the known inserts cannot be said to be interchangeable or substitutable.

By contrast, the inserts of present invention do not require any adhesive, glue, or screw type mechanism to secure the inserts into a pre-drilled bowling ball hole. Rather fixation of the insert onto the hole is accomplished by using an interlocking projection, described below, fused to the external surface of the insert, at a point on the longitudinal axis of the insert where an insert diameter reduction begins. This interlocking projection extending from the external surface of the insert interfaces with a groove of the same size and shape within the inner wall of the pre-drilled hole of the bowling ball, thereby producing an automatic interlock and stabilizing-fixation of the insert inside the bowling ball hole.

Further still, known art has attempted to relieve swelling by a series of circumferential fluted grooves, inter-positional air space between insert walls, or multiple nested, concentric circular cylinders. The present invention employs none of these features. Because fluted grooves and interpositional air spaces as shown in the art do not address digital contraction, and because the nested cylinders are circular and non-anatomical in shape, (although sometimes capable of accommodating digital contraction) the present invention simultaneously addresses both the contraction and expansion of the bowler's fingers by using multiple size presentations of the exact anatomical shape of the non-swollen digit. The various presentations of the insert are made both larger than, and smaller than, the normal sized digit of an individual bowler, when the digit is neither swollen nor constricted, so that natural ligamentous constraints on the digital shape changes are addressed in both the expansile and contractile forms.

Also anatomical deformities of a particular bowler's fingers (such as calluses and bone growths) are easily and automatically incorporated into the new inserts. This is an important feature not found in non-anatomically shaped inserts of circular or oval form and provides a much greater degree of comfort for bowlers with such anatomical abnormalities.

The present invention also employs digital diameter reduction in a manner which is different than the patented of device of Todd and Hibler, which is designed for use of both ends of the described bowling ball insert for finger insertion. Further the device of Todd and Hibler is pressed uniformly at each end of the insert against the interior wall of the containment hole of the ball.

The present invention allows finger insertion only at the larger diameter outer end of the new insert, because of its anatomically correctly adapted shape. The diameter reduction begins at the interlocking projection and extends to the tip of the finger at the bottom end of the insert. The bottom end of the insert does not touch the bottom of the hole in the bowling ball, nor do the sides of the insert for the length of diameter reduction touch the inside wall of the rigid ball hole. Essentially, the portion of the present invention from the bottom end to the point just before the start of the interlocking projection along the length of the insert having diameter reduction is actually free-floating within the hole, enabling the compressible elastomer of which the insert is made to help in relieving some of the discomfort encountered during expansive digital swelling.

The present invention uses a circular plate with a central aperture incorporated into the bottom end of the insert just beyond the tip of the anatomically configured internal insert cavity. This plate enables facile, rapid manual removal of the insert from the ball hole and aids in the facile introduction of another i.d. size insert. An end-threaded rod mates with the centrally threaded portion of the plate allowing the insert to be simply lifted out of the ball hole. And further, the present invention can consist of multiple elastomeric components within a single insert, the different elastomers being employed for their specific properties of different hardness and softness, and different frictional characteristics. The combination of the multiple elastomeric components, as described hereafter, in a single "finger hole" insert aids the bowler in obtaining optimum performance, by effecting either a faster or slower finger (digit) extraction, as may be required, from the insert on release of the ball during bowling. Such construction and the effects thereof are found nowhere in the known art of inserts for bowling ball holes.

A further advantage of the bowling ball hole insert of the present invention is that it is extremely durable as compared to the art. With known inserts it is common for a competitive bowler to need to replace the inserts at least four times per year. By contrast, the new inserts, due to the described construction, will perform for at least a year, thereby making the new customized inserts very economical in the long run.

BRIEF SUMMARY OF THE INVENTION

Accordingly, it is among the goals of the present invention to provide an insert for bowling balls which insert is made available in a plurality of sizes of an exact anatomically configured "finger insert" for a bowling ball that are self-locking, adhesive-free, and easily interchangeable by the bowler without the assistance of others. Interchangeability of the various i.d. sizes of inserts is accomplished in part by using a small, end-threaded, cylindrical rod that screws into a centrally and correspondingly threaded plate in the bottom end of the insert, allowing the bowler to lift out one size insert and replace it with another insert of different size of the same anatomical configuration; i.e. of the same bowler's digit. The plurality of sizes use a baseline size which is defined herein as being equal to a mold size of the corresponding digit in its normal, non-swollen and non-shrunk/contracted state. Further sizes are provided to accommodate the increasing and decreasing girth of the bowler's digit by expansion and reduction of the internal perimeter of the insert.

The new device addresses the various phases of swelling and contraction in size of the bowler's digit diameter. It is further among the goals of the present invention, having the features indicated, that the new bowling ball hole inserts be made in a variety of elastomers, either alone or in combination, used in various geometric distributions, and in various levels of hardness, in order to provide optimum ball release by the bowler.

The present invention is preferably formed of several types of elastomers, multiple forms of which may at times be used in a single insert. The different hardness-softness characteristics and frictional properties of the various elastomers selected facilitate the new insert's ability to produce different extraction speeds for removal of the digit out of the inserts, so that during release of the ball, the bowler's thumb exits faster than the bowler's fingers, as is necessary to increase ball revolution speed on release.

The self-locking mechanism includes at least one projection, which may be varied in size, shape and number, and which is preferably formed integrally with the external surface of the ball hole insert and extends from any point on the external cylindrical surface of the insert below the level of the ball surface. The insert side extension produces a self-locking or detenting function by interfacing with a groove of an appropriately corresponding size and shape formed (for example by routing) into the inner wall of the pre-drilled ball hole. The locked insert is released automatically when the groove projection interface is separated by the action of a second rod that is wedge-tipped. Upon such release, the insert is then readily lifted out of the ball hole, by virtue of the first rod's threaded connection into the round plate at the bottom (innermost) end of the insert.

It is further among the goals of the present invention that the new inserts be self-locking, so as to not require the use of any adhesives or other substances to cause them to be secure in the bowling ball hole, and yet capable of facile and quick removal and interchangeability by the bowler without assistance of other persons, especially of professionals. A plurality of different sizes of precise anatomically configured inserts for the holes of a bowling ball representing the same finger of a particular bowler are interchangeable into the same finger hole, of one or multiple bowling balls. The necessity for interchangeability of the new inserts is dictated by the size changes in the fingers of a bowler produced by swelling and shrinkage of the bowler's digits. Each of the different sized inserts which form a set of inserts is self-locking in a bowling ball hole without the use of adhesive or glue, thus making it possible for a bowler to exchange insert sizes at any time without professional assistance, by using extractor tools designed for use with the new inserts. Each individual insert of the plurality of inserts may be formed of one or more elastomers to take advantage of different hardness levels and frictional properties of the various elastomers commercially available, to thereby create a friction differential within the same one of the plurality to facilitate extraction of the finger from the insert during bowling and to increase durability of the inserts.

Accordingly, in view of the above-listed goals and advantages of the present invention, the invention is, briefly, a customized, anatomically correct insert for a bowling ball which includes a main body portion having a first end and a second end. An outer portion of the insert has a first end and a second end, the first end being flush with the surface of a bowling ball with which the insert is intended to be used, when in normal use position, and the second end being connected to the first end of the main body portion of the insert. The outer portion of the insert is positioned at the mouth of a bowling ball hole when the insert is in normal use position in the bowling ball hole and has a greatest external dimension substantially equal to the internal dimension of the bowling ball hole, so as to be capable of being press-fit into the bowling ball hole, yet not being so large as to be subject to becoming so tightly stuck within the bowling ball hole that it cannot be selectively removed by the bowler. The main body portion has an outer side wall with a greatest external dimension which is less than the greatest external dimension of the generally outer portion, so that an air space remains between the outer side wall of the central portion and the wall defining the bowling ball hole, and the main body portion and the outer portion have formed therein an anatomically correct cavity for receiving a finger of a bowler for whom the insert is custom-made.

The invention further includes, briefly, a method of making a customized, anatomically configured insert for a bowling ball hole, in which a mixed, pre-cured silicone rubber is applied to a bowler's preselected digit. The silicone rubber is allowed to fully cure on the digit and then is removed en bloc from the digit. The remaining rubber block thus contains a precise anatomically configured mold of the digit. The anatomically configured mold is then filled with a slurry of dental stone modeling compound, which is allowed to cure and then is removed from the anatomically configured mold. The cured dental stone model is placed into a structured cylindrical containment mold which has a round plate with an aperture therethrough at the bottom of the containment mold. The containment mold is then filled with one or more elastomers, which are allowed to cure at room temperature, before removing the fully cured elastomer construct with the round plate fused thereto and the dental stone model from the containment mold. The dental stone model is removed from the inside of the elastomer construct; thereby producing a baseline sized insert formed of one or more elastomers for a particular preselected digit of a particular bowler.

The new method further includes, briefly, providing steps for increasing the interior size of the anatomically correct bowling ball finger hole insert to produce a plurality of inserts representing multiple sizes of the insert for the same digit of the same bowler by: applying a molten molding substance to the external surface of the dental stone model, extending from any prominence or prominent deformity to the outer end of the dental stone model in uninterrupted fashion to thereby create mold-induced space channels; placing the dental stone model with space channels thereon into a molten molding substance bath for approximately one second; and allowing the molten molding substance to totally cover the dental stone model with space channels and to harden into a solid mass; thereby expanding the perimeter of the baseline dental stone baseline size of the dental stone unit by a single unit size, making it the next unit size larger while reproducing the same anatomical shape as the baseline unit. The new method further includes, briefly, providing further up-sized anatomically configured finger hole inserts for a bowling ball by repeating the steps of the last paragraph as many times as desired, to thereby sequentially provide further progressively upsized inserts.

The new method further includes, briefly, providing steps for decreasing the interior size of an anatomically correct bowling ball finger hole insert to produce a plurality of inserts representing multiple smaller sizes of the insert for the same digit of the same bowler, by: applying molten molding substance to the internal surface of the mold of the digit produced in high purity silicone; allowing the molten molding substance to harden; adding a slurry of dental stone to the coated cavity of the high purity silicone; and allowing the slurry of dental stone to harden, thereby creating a dental stone model with the same anatomical shape as the baseline unit, but with a smaller id than the baseline unit by the thickness of one coat of molten molding substance.

The new method further includes, briefly, providing further progressively down-sized anatomically configured inserts for the preselected digit of a bowler by repeating the steps of the paragraph directly above as many times as desired, to thereby obtain as many separate but progressively down sized inserts which are all anatomically correct for the preselected digit of the bowler.

These and other advantages and goals of the invention will be in part apparent and in part pointed out hereinbelow.

BRIEF DESCRIPTION OF DRAWINGS

FIG. 11 is a side elevational view of a wedge rod used with the present invention.

FIG. 12 is a side elevational view of the wedge rod of FIG. 11, rotated 90° clockwise on the longitudinal axis.

FIG. 13 is an end elevational view taken on line 13—13 of FIG. 12.

FIG. 14 is a side elevational view, partially cut away, of the insert of FIG. 1 seated in a bowling ball hole.

Throughout the figures like parts will be indicated by like element numbers.

DETAILED DESCRIPTION OF THE PRACTICAL EMBODIMENTS

With references to the drawings, 100, 200 generally designate a multiple sized interchangeable, self-locking, adhesive-free, variable hardness, anatomically configured "finger insert" for a bowling ball hole. Insert 100, 200 as described further hereafter, is a logical evolution of a previous application for a bowling ball insert, that application describing multiple presentations of finger inserts that actually incorporate the shape of the human anatomy, normal or abnormal, into their configuration and therefore, the previously filed, now pending, "Multiple Presentation Anatomically Configured Finger Inserts for a Bowling Ball", filed Sep. 10, 1998; (Ronald J. Lakusiewicz inventor and applicant), the disclosure of which is incorporated herein by reference, in its entirety.

FIGS. 1–4 and 14 herein illustrate a bowling ball hole insert 100 of a type useful for a thumb hole in a bowling ball, whereas FIGS. 5–8 and 15 show a related insert 200, which is of a type more suitable for use for a finger (here, regarding the embodiment shown in these figures, meaning any of the bowler's middle three or last four digits; i.e. any digit except the thumb) hole in a bowling ball.

Figure 2:
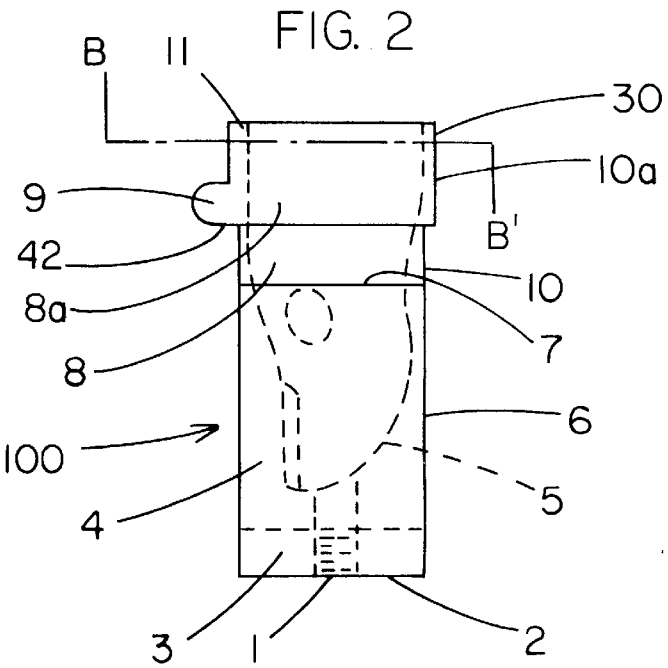
FIG. 2 is a side elevational view of the insert of FIG. 1, rotated 90° clockwise on the longitudinal axis of the insert.
Figure 1:
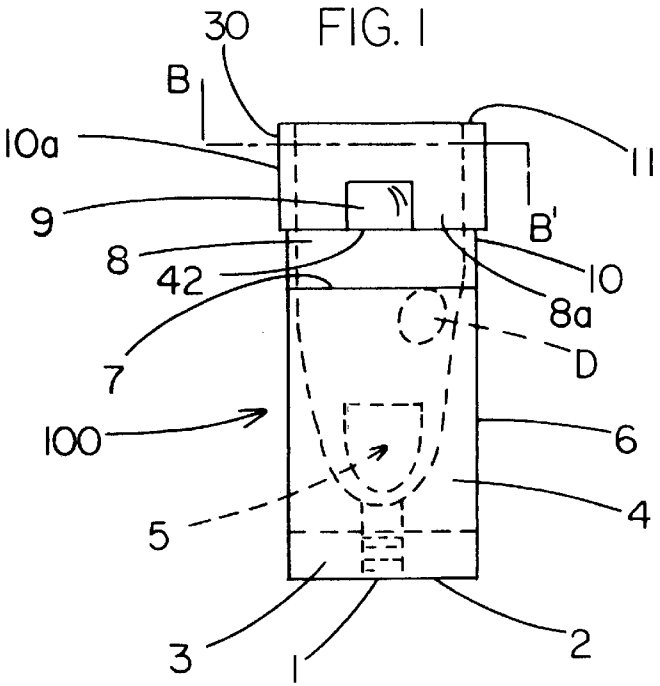
FIG. 1 is a side elevational view of an insert for a bowling ball hole for a thumb, the insert being constructed in accordance with and embodying the present invention.

FIGS. 1 and 2 show insert 100 of the present invention, which insert is ordinarily generally cylindrical and preferably, although not necessarily formed of two different elastomeric materials. Insert 100 is intended to be selectively removably disposed in the predrilled thumb hole of a bowling ball. Insert 100 has, when considered from its normal use position in a bowling ball hole a plate 3 at the bottom of the hole, a central cylindrical portion 4 and an outer portion formed of two segments 8 and 8*a*, 8*a* being integral to segment 8 and disposed outermost. For purposes explained further hereafter, cylindrical portions 4 and 8/8*a* are preferably formed of two different elastomeric materials; i.e. portion 4 is formed of one material and portion 8/8*a* is formed of another material.

Portions 4 and 8 preferably have the same diameter and are fused in coaxial, abutting (end-to-end) relation to one another along a substantially transverse "fusion plane" indicated for example at line 7, with portion 8 being more outward and portion 4 being more centrally located when insert 100 is disposed in normal use position in a bowling ball hole. In the most preferred embodiment fusion plane is disposed at point along the longitudinal axis of insert 100 at which point represents the greatest dimension across the anatomical digit cavity 5; i.e. representing the point at which a thumb for which the insert 100 is custom made has its greatest girth.

Portion 8*a* has a cylindrical outer wall surface 10*a* and has a wider external or outside diameter (o.d.) than the cylindrical outer wall 10 of cylindrical central portion 8 and wall 6 of central cylindrical (or main body) portion 4.

Insert 100 has an outwardly directed ("outer") end surface 11 with an entrance opening 12, which opening is preferably but not necessarily formed substantially centrally on surface 11 and provides communication between the exterior of the insert and a hollow anatomically configured thumb cavity 5. Insert 100 further has an inwardly ("bottom" or "inner", relative to the insert use position in the ball) directed end surface 2 that is the bottom surface of round plate or disk 3. Plate 3 has a centrally disposed aperture or through hole 1, and is formed of an additional and different substance than the elastomers of cylindrical portions 4 and 8. Aperture 1 is preferably threaded, for purposes to be explained hereafter, and allows communication between the hollow anatomically configured digit cavity 5 and the external surface of the bottom end 2 of insert 100. The diameter of disk 3 is substantially the same as that of central portion 4.

Also showing in FIG. 1 is an interlocking (detenting) projection 9 (further explained hereafter), which is located on the cylindrical wall 10*a* substantially adjacent to outer end surface 11 of insert 100. The same o.d. of portion 4 of insert 100 begins at the inwardly directed side 42 of the projection 9 and extends to the extreme bottom of the insert, defined by inwardly directed end surface 2 of plate 3. FIG. 1 also illustrates at broken line B-B' the plane which defines the level of overhang 30 of the insert, which overhang will temporarily exceed the surface of the bowling ball. Overhang (overextending area) 30 must be removed prior to use, when the insert is fully seated in normal use position in a bowling ball, so that outmost end 11 of insert 100 is substantially flush with the outer curved surface of the bowling ball in which it is disposed.

FIG. 2 illustrates insert 100 for a thumb hole of a bowling ball 39 and shows one of the possible and practical embodiments of the interlocking projection 9 which, in this presentation, is singular, proportionate, and does not extend uninterrupted for 360° around the exterior wall surface 10*a* of the wide diameter cylindrical portion 8*a*. It is to be understood, however, that the detenting projection 9 could take other, alternative shapes and positions, as long as it is shaped and positioned on wall 10*a* to correspond to and interlock with an alternatively shaped detenting groove or other engagement mechanism. For example, projection 9 could extend uninterrupted around the entire circumference of insert 100 on the widest portion thereof, wall 10*a*.

Figure 3:
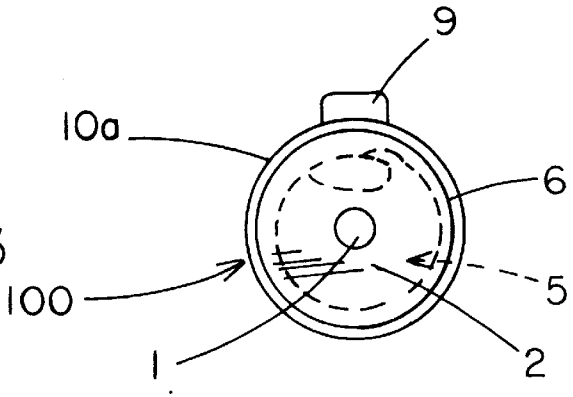
FIG. 3 is a bottom plan view of the insert of FIG. 1.

FIG. 3 shows the inwardly directed ("bottom") end surface 2 of insert 100 for a thumb hole of a conventional bowling ball (such as that indicated at 39 in FIG. 14.). Insert 100 has an overall cylindrical external shape, with a larger diameter at the outwardly directed end portion 10 and a reduced diameter at its central portion 6. The diameter of central portion 6 is preferably, although not necessarily, the same as the end portion 3. The general cylindrical shape of 100, 200 is provided to match the conventional perimeter of a bowling ball hole. However, it is to be understood that if bowling balls are ever provided with finger and thumb holes which are not exactly round then the new inserts can be moldably formed to fit into such non-cylindrical bowling ball holes.

Figure 4:
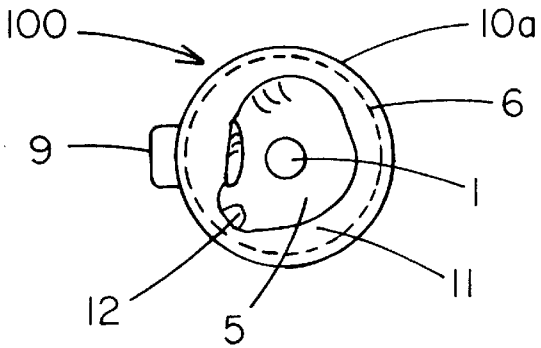
FIG. 4 is a top plan view of the insert of FIG. 2.

FIG. 4 shows the outwardly directed end surface 11 of the new insert 100 for a thumb hole, illustrating an example of the entrance opening 12 to the anatomically configured thumb cavity 5, which cavity is understood to vary in shape, depending upon the anatomical formations or deformations of the thumb of an individual bowler for which such insert 100 is custom made.

Figure 5:
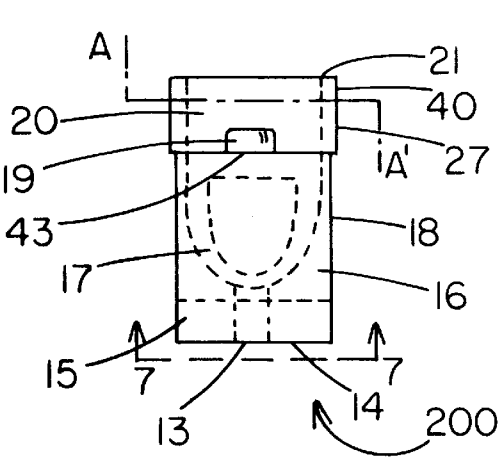
FIG. 5 is a side elevational view of an alternative embodiment of the insert of FIG. 1.

FIG. 5 illustrates an insert 200 of the present invention for a finger hole, which is to be understood to be constructed substantially as described with reference to insert 100 (for the thumb hole), except for any specific differences, indicated below. Insert 200 for a bowling ball finger hole includes a central cylindrical portion 16, contiguous and coaxial with an outer cylindrical portion 20, which portions 16, 20 are integrally formed, by molding of a single type of elastomeric material. Portion 20 has an outwardly directed end surface 21, with an entrance opening 22 that communicates from the exterior of the insert to a hollow anatomically configured cavity 17 formed in the insert during the manufacturing process.

A bottom, inwardly directed end surface 14 of insert 200 defines the bottom facing surface or extent of a round plate 15, which plate 15 is formed of a solid substance, such as plastic or light weight metal, such as aluminum, or other such material capable of being modified and used as described hereafter. Plate 15 is fused or otherwise coaxially connected on the inwardly directed end of central cylindrical portion 16, and has an o.d. substantially the same as that of the outer cylindrical side wall 18 of portion 16. Round plate 15 has a substantially central through hole or aperture 13 that allows communication between the hollow anatomically configured finger cavity 17 and the inside of the ball finger hole 33. Aperture 13 is preferably, although not necessarily, threaded for purposes described hereafter.

Also shown in FIG. 5 is the interlocking projection 19 located on the curved outer surface 27 of the outwardly directed cylindrical portion 20 of insert 200. Cylindrical portion 20 abuts endwise and coaxially a cylindrical portion 18, which has a somewhat relatively reduced (e.g. preferably by a matter of about several millimeters) diameter relative to cylindrical portion 20. Cylindrical central portion 18 is preferably, but not necessarily of the same diameter as the inwardly disposed cylindrical end plate 15 and extends from the bottom (inwardly facing) side 43 of projection 19 to and abuts with the innermost end 14 of insert 200.

FIG. 5 also illustrates a plane, indicated by line A-A', showing the level of preferred maximum overhang or excess material 40 to exceed the bowling ball surface. Overhang 40 is eventually removed after manufacture when the insert is fully seated in the ball, so that there is no excess material remaining beyond the surface of the ball when insert 200 is seated in normal use position. Rather, the insert outer end 21 must be substantially flush with the outer surface of the bowling ball in which it is seated, and is made so by shaving or otherwise smoothly reducing the elastomeric material of end 21.

Figure 6:
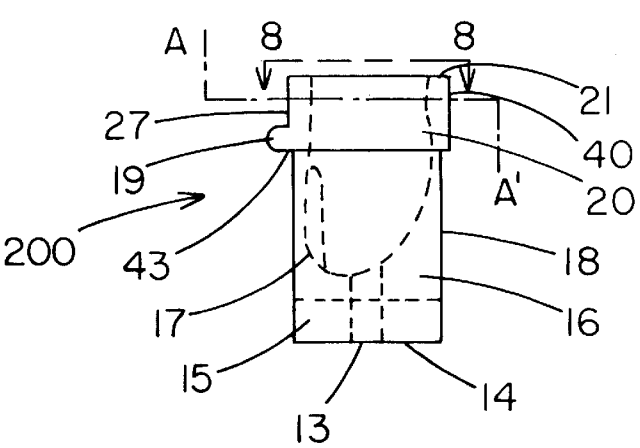
FIG. 6 is a side elevational view of the insert of FIG. 5, rotated 90° clockwise on the longitudinal axis.

FIG. 6 illustrates insert 200 of FIG. 5 for a finger hole, showing one of the selectively variable positions of the interlocking projection 19 which (like projection 9 on insert 100) in this presentation is preferably singular, portionate and not extending uninterrupted for 360° around the wider diameter portion 20 of the outer end 21. Alternatively, other examples of useful constructions include that detenting extension 19 can have other shapes or can extend as a ridge entirely or partly around the circumference of portion 20. A variety of conceivable constructions are acceptable as long as the structure permits detenting or other engagement of the insert within the corresponding bowling ball hole sufficiently securely that the insert will not inadvertently slip out of the hole when the bowler releases the ball while bowling.

Figure 7:
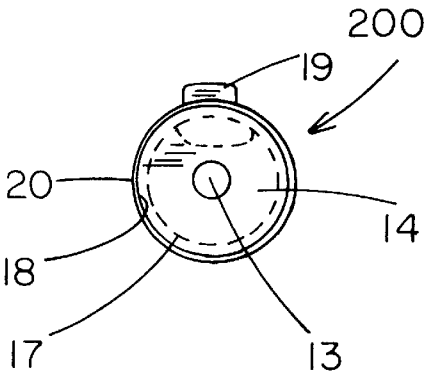
FIG. 7 is a bottom plan view of the new insert taken on line 7—7 of FIG. 5.
Figure 8:
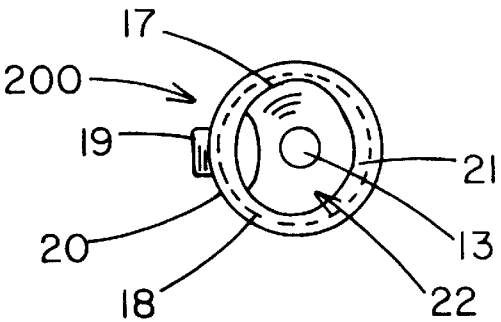
FIG. 8 is a top plan view of the insert taken on line 8—8 of FIG. 6.

FIG. 7 shows the bottom (inwardly directed) end 14 of insert 200 for a finger hole of as bowling ball, showing the preferred cylindrical shape of the insert and the wider diameter portion 20 extending beyond the circumference of the reduced (smaller) diameter portion 18 from the end. FIG. 8 illustrates the outwardly directed end 21 of insert 200 and 22 designates an entrance opening to the anatomically configured finger cavity 17.

Figure 9:
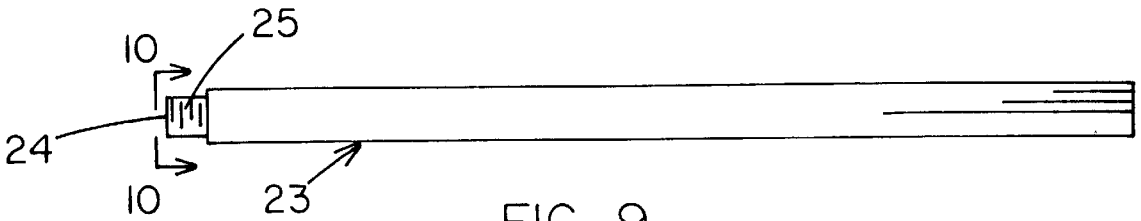
FIG. 9 is a side elevational view of an extraction rod for use with the insert of the present invention.
Figure 10:
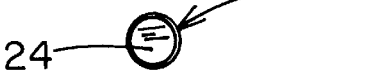
FIG. 10 is an end elevational view of the extraction rod of FIG. 9.

FIG. 9 shows the preferred rod shaped structure for an extraction tool 23, the use of which is described in further detail hereafter. Rod 23 preferably has an end 24 provided with threads 25, and as seen in FIG. 10, desirably has a slender cylindrical shape. It is conceivable, however, that the extraction tool may take some other useful form, as will be made clear later herein.

FIGS. 11–13 show a wedge rod 26 for use in accomplishing facile and quick removal of an insert 100, 200 from a corresponding bowling ball hole. The wedge extent 45 is preferred to be ¾ inch from the bottom end 29 of the wedge rod 26 and the wedge plane 28 surface. FIG. 12 shows the wedge plane 28 of wedge rod 26 to be angled, preferably by approximately 20° from its wedge plane extent 45 to the flat tip or end 29 of the wedge rod 26. FIG. 13 further illustrates the end 29 of wedge rod 26 and shows the preferred cylindrical shape of the rod. The wedge plane or surface 28 and the opposite end 29 of the wedge rod 26. Certain variations on the form of wedge rod 26 can be conceived that would also be useful for the intended purpose.

FIG. 14 illustrates insert 100 seated appropriately for use in a pre-drilled hole 33 in bowling ball 39. An overhang 30 remains on the outwardly directed end of insert 100 and must be trimmed away in order to match the outer end of insert 100 at plane B-B' to the smoothly curved outer surface of the ball 31. The interlocking projection 9 of insert 100 fits into an annular groove 32 in a digit hole of ball 39, the groove preferably (although not necessarily) extending 360° around the annular inner surface of ball hole 33 in ball 39. It is desirable, although not required that projection 9 be provided with a radius of 1/16 to 1/8 inch. It is likewise preferred, but not required, that groove 32 have a radius of 1/16 to 1/8 inch, as long as the respective sizes and shapes of projection 9 and groove 32 are formed for interlocking or detenting engagement with one another, there is reasonable variation in the structure conceived. These structural limitations and variations are also conceived for the detenting arrangement of projection 19 of insert 200 and groove 35 of corresponding ball hole 36.

FIG. 14 also shows the wider diameter portion 10 of the insert fitting snugly in apposition to the annular inner wall surface of the ball hole 33 and the reduced diameter portion 6 of the insert slightly spatially separated from the inner wall surface of the ball hole 33 by a space 34. The bottom (or inwardly directed) end 2 of the insert is separated from the surface of the ball hole 33 by an air space 34*a* which is contiguous with space 34.

Figure 15:
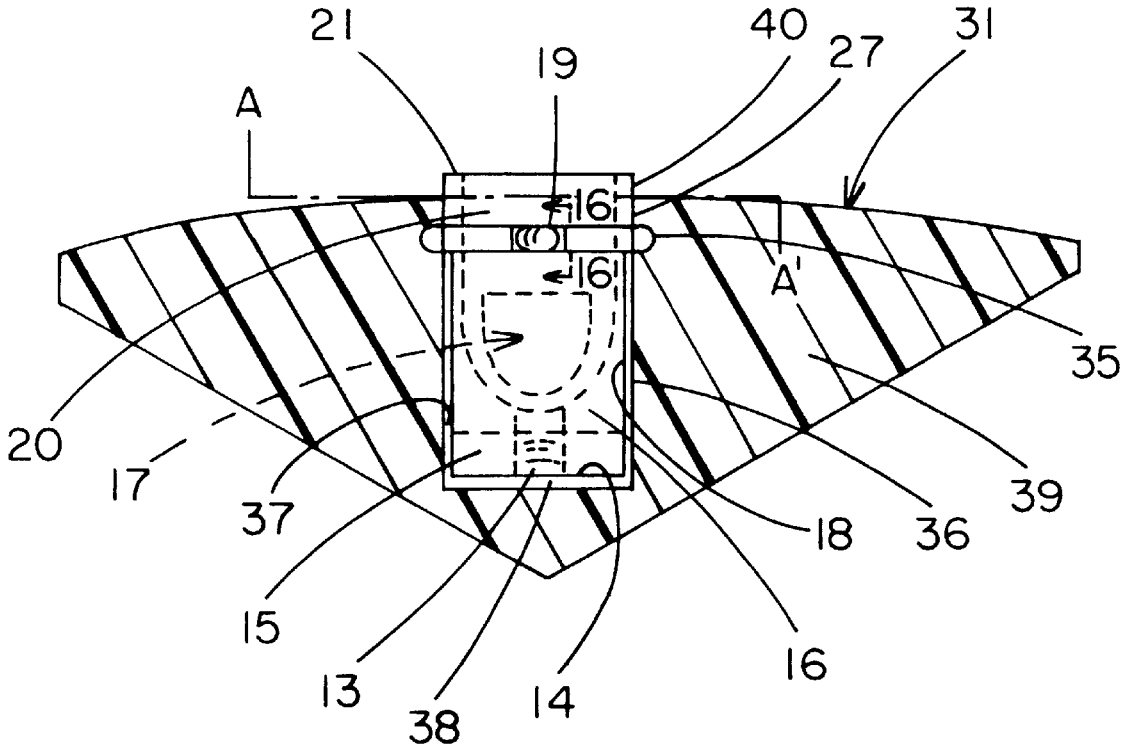
FIG. 15 is a side elevational view, partially cut away, of the insert of FIG. 5 shown seated in a bowling ball hole.

FIG. 15, illustrates insert 200 seated appropriately in the pre-drilled hole 36 of a bowling ball 39. Overhang 40 is trimmed away to plane A-A' before the first use of the insert in normal use position, so that the outer end surface of insert 200 is substantially the same as the curved surface of the ball 31. The detent projection 19 of the insert fits into a detent groove, which preferably extends 360° around the inner wall of ball hole 36 into the ball 39, and also showing the wider diameter portion 20 of the insert fitting snugly in apposition to the surface of the ball hole 36. The reduced diameter portion 18 of the insert is slightly spatially separated from the annular side wall surface defining the ball hole 36 by an annular space 37. The bottom end 14 of the insert is separated from the bottom of the ball hole 36 by a space 38.

Figure 16:
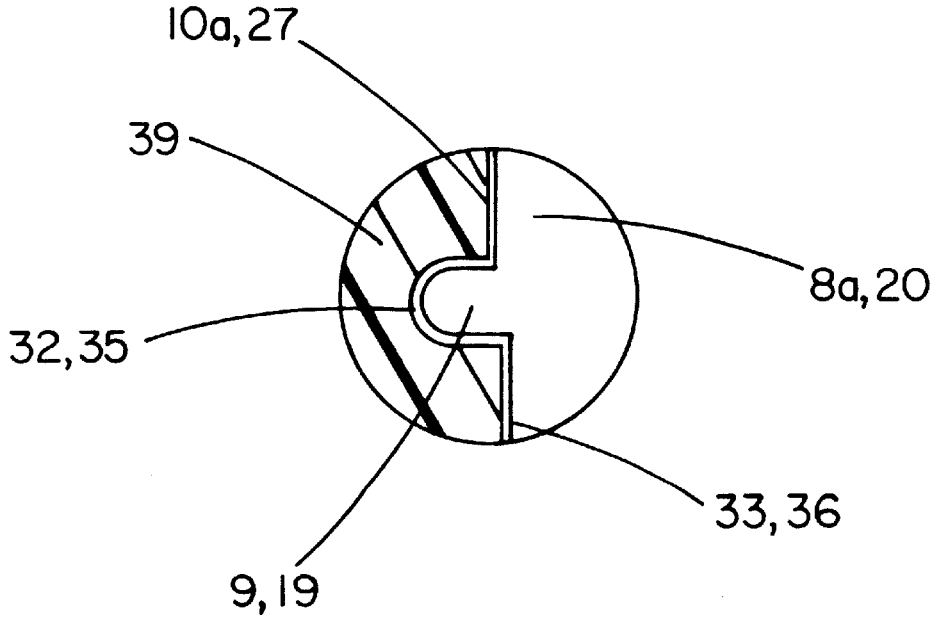
FIG. 16 is an enlarged partial sectional view of the interlocking mechanism taken on lines 16—16, 16'—16' respectively of FIGS. 14 and 15.

The interlocking mechanism of FIG. 16 is representative of the interlocking mechanism of the new bowling ball hole insert for both a thumb hole insert, as shown in FIG. 14 and a finger hole insert, as shown in FIG. 15. FIG. 16 provides an enlarged view of a groove which conforms to either groove 32, 35 formed on the inner surface of the corresponding ball hole 33, 36, respectively, and extending into the ball 39. Groove 40 provides "interdigitation" or detenting engagement with projection 9, 19 to secure the insert within the ball hole. The separation between the detent projection 9/19 and groove 32, 35 is shown exaggerated in the figure, for clarity. For optimal performance the projection would be quite snug within its respective groove. The engagement of insert 100, 200 within ball hole 33, 36 is further secured by the snug apposition of the wider diameter portion 8*a*, 20 of the corresponding insert to the annular inner wall surface at the outermost or outwardly directed end of the ball hole 33, 36.

Use of the new Inserts:

The present insert 100, 200 evolved because of the problem of constant changes in size of the bowler's fingers, particularly the thumb, caused by swelling that every bowler experiences and that has remained an unsolved problem up to the present. The present bowling ball hole insert addresses the problem of finger size changes which are directly due to natural swelling and the inability of the bowler (alone or with assistance) to control such size changes. This is accomplished with the new insert described herein, because it is easily made available in multiple, preselected interior diameter sizes, all of which are formed to the precise anatomically configured shape of each one of a particular bowler's fingers and thumb. The new inserts are also sufficiently durable that an experienced bowler can employ them for heavy use at least three to four times as long as conventional bowling ball hole inserts.

The new inserts require custom-made interiors incorporated into a series of standardized o.d. cylinders formed of various different preselected elastomeric materials. The multiple inserts of a set for a particular digit of a particular bowler are interchangeable one with another in the same ball hole, even though each one can be facilely secured in normal use position in such manner as to not risk inadvertent slipping of the insert out of the ball during bowling. This is accomplished by selectively removably securing the insert in the corresponding hole of a bowling ball by use of a securing mechanism (shown enlarged in FIG. 16). Securing insert 100 or 200 in a ball hole by the preferred method simply requires sliding the insert into position and press fitting a detent projection on the insert into a detent groove formed in the ball hole. Interlocking projection 9, 19 on the insert engages a corresponding groove 32, 35 formed on and extending into the inner surface defining ball holes 33, 36 of ball 39. This detenting engagement, along with the snug fit of the wider diameter portions 8*a*, 20 of insert 100, 200, in apposition to the inner surface of the respective ball holes 33, 36, makes adhesives such as various glues unnecessary and permits the bowler to place the insert into normal use position.

Insert 100, 200 is quickly removed at any time by using rod devices 23, 26. In this manner either a larger or smaller digit girth size presentation of the insert for a particular digit can be selected and placed into the corresponding ball hole 33, 36 to accommodate swelling or shrinkage of the fingers and thumb, to at all times allow comfortable fit of the thumb and fingers in the ball 39.

The Manufacturing Method:

In order to obtain the proper anatomical configuration 5, 17 for each particular bowler's thumb and fingers a "standardization method" described herein is used, with modifications conceived. A positive digit mold is made by simply placing the thumb or finger (or each of them) into a special molding substance that is safe against the skin. The molding substance is preferred to be, but is not necessarily limited to, a high purity silicone rubber, which is widely commercially available, such as that sold under the tradename "Ply-O-Life". In the pre-cured state, the high purity silicone rubber is present in two parts in the pre-cured state. When mixed together in equal parts at room temperature and applied to the fingers or thumb over any moisturizer (such as hand lotion, for example) which facilitates removal of the high purity silicone rubber, the molding material will cure safely at room temperature without harm to the user.

The pre-cured mixture of high purity silicone rubber is, initially, a smooth thick liquid or "paste" in consistency, which transforms into a "cured" flexible semi-solid consistency in approximately seven minutes. The selected digit is then easily extracted from the high purity silicone rubber mold which represents an exact copy of the digit. The anatomically configured negative mold thus formed, although not the end product insert, is made of high purity silicone rubber and is the standardized piece that permits all subsequent inserts made therefrom to be precisely the same in size and shape, customized for a specific digit of a particular bowler.

A slurry of known, commercially available dental stone modeling compound, is then introduced into the high purity silicone rubber anatomically configured negative mold and allowed to set-up at room temperature thus becoming "rock hard", then being easily removed from the high purity silicone rubber mold. The rock hard dental stone model which is now the positive mold of the finger or thumb is placed centrally located, and coaxially aligned, into a rigid cylinder containment mold whose inner diameter is substantially equal to the diameter of the drilled hole of the bowling ball.

One conceivable acceptable alternative embodiment of the preferred method for standardizing an insert for an individual bowler is to not provide a centrally located circular projection formed inside the bottom of the containment mold. Instead, the positive finger or thumb mold is placed in and coaxially aligned with the containment mold. The outer end of the positive finger or thumb mold is positioned to rest on the bottom of the containment mold and held securely in such position by an elastomeric ring which is coaxially aligned with and occupies the space at the bottom and inside of the containment mold, between the positive finger or thumb mold and the containment mold.

A further possible modification to the use of the present invention is to not use the described solid cylindrical rods for insertion into and removal of the insert from the corresponding bowling ball hole. Although perhaps less optimal than the preferred method of insertion and removal described, other structures can be conceived which will permit such action. For example, the provision of a gripping tab on the outer edge of the insert could suffice.

The end product digit hole insert is obtained by placing appropriate part mixtures of base and catalyst of a plurality of different elastomers such as but not limited to, commercially available, external prosthetic quality silicones, or room temperature known vulcanizing RTV liquid rubber polyurethane (also commercially available) into the containment mold to totally bathe the entire contents. More specifically, the positive finger or thumb mold and a round plate 3, 15 with openings 1, 13, and which has an outer diameter equal to the inner diameter of the containment mold, and has been introduced into the end of the containment mold adjacent to the bottom end of the positive finger or thumb mold. The round plate 3, 15 is formed of a material, such as but not limited to, light weight aluminum, or a rigid, high density plastic and is incorporated into the bottom end 2, 14 of the insert by fusion to the cylindrical elastomeric portions 4, 16

The containment mold (not shown), is preferably formed of, but not limited to, polyethylene, plastics, or a metal such as a hard coat anodized aluminum or stainless steel, for example. Prior to placing the mixture of one or more elastomers into the containment mold, the dental stone positive mold is coated, only on the baseline model of the finger or thumb, with a separator substance, such as but not limited to a petroleum soap compound or zinc stearate. No separator is placed on the round plate 3, 15. The inner wall of the containment mold is lined with either polyethylene sheeting or waxed paper. The wider diameter portions 8*a*, 20 and reduced diameter portions 4, 18 of the insert formed in the mold are size-determined by the level of introduction along the longitudinal axis of the containment mold and thickness of the polyethylene sheeting and waxed paper. The size and shape of interlocking projection 9, 19 of the insert are determined by the size and shape of an out-pocket or convex area formed in the containment mold.

The multiple sizes of anatomical configuration for a specific finger or thumb are constructed by perimeter expansion technique including starting with the positive baseline model of the finger or thumb, using a substance such as but not limited to, molten beeswax applied with a syringe to produce "space channels" carved appropriately, to allow anatomical deformities or excessive prominences on the subject digit to easily exit the anatomically configured cavity 5, 17 of the insert. Then the already "space channeled" positive finger or thumb mold is immersed for 1 second in the molten beeswax bath. This procedure will produce a precisely anatomically configured cavity 5, 17 of the insert that is upsized to +1 level coating.

To produce further upsizing, the already upsized +1 coated positive finger or thumb mold is immersed in the molten beeswax bath for 1 second. This step adds another coating of wax, producing an anatomically configured cavity 5, 17 of the insert that is upsized +2 coating. Still further upsizing is accomplished by taking the already upsized +2 coated positive finger or thumb mold and immersing it in the molten beeswax bath for 1 second, to thereby add another coating of wax and producing an anatomically configured cavity 5, 17 of the insert that is upsized +3 coating, and so on, for even further upsizing if desired. All upsized anatomically configured cavities 5, 17 that are obtained from this perimeter expansion technique of the positive finger or thumb molds are constructed using the same outer diameter ("o.d.") sized cylindrical containment molds. Thus, the o. d. of greater diameter portions 8*a*, 20 of the insert will be the same for each upsized insert piece, and each will thus fit into the same ball hole. The inner diameter of the ball hole equals the outer diameter of greater diameter portions 8*a*, 20 of all insert pieces, thereby rendering the plurality of upsized insert pieces so formed to all be interchangeable with respect to the same ball hole and with each other.

It is very important to understand that expansion takes place in the body, and specifically in this case of the fingers and thumb along well defined anatomical planes that are maintained by ligamentous constraints. As the expansion or enlargement of the digit increases, the elastic property of the anatomy allows even further distention of the planar configuration such that anatomical definition becomes lost and circulation to the finger or thumb tip and skin becomes compromised. Notably, this same exact phenomenon of loss of anatomical definition of the fingers and thumb is reproduced by coating the positive finger or thumb mold with multiple coats of beeswax, and that each coating represents a different degree of expansion, and that the perimeter expansion technique allows the degrees of expansion to take place in accordance with the configuration of a specific bowler's specific finger or thumb anatomy. Therefore, the surprising success of this particular perimeter expansion technique is due to the fact that technique described herein most closely represents the actual way in which the fingers and thumb expand as a result of swelling.

To contend with the problem of digital contraction a thin coating of molten beeswax is introduced into the negative anatomically configured cavity of the high purity silicone rubber mold initially taken off the bowler's fingers and thumb. Dental stone slurry is then placed into the waxed cavity so that when fully set and hard, the positive finger or thumb mold of hardened dental stone now has the exact anatomical configuration of the bowler's fingers or thumb, but the internal perimeter of digit cavity 5, 17 is smaller and thusly, formed to a contracted size −1 coating. If a second coating of molten beeswax is applied to the already coated high purity silicone rubber mold of a size −1 coating, then a further contracted mold of size −2 coating will be produced, yielding a positive dental stone digit mold that is smaller or contracted to a −2 coating size.

Therefore, inserts 100, 200 at final construction are available, all with the same o.d. within a particular "digit set"), but in a plurality of different internal sizes of the beginning normal or "baseline" anatomical configuration digit cavities 5, 17 represented as follows:

| <- - - - - - - - - - - - COATED SIZES - - - - - - - - - - - - -> | | | | | | | |
|---|---|---|---|---|---|---|---|
| ETC., | −2 | −1 | 0 | +1 | +2 | +3 | ETC. |
| CONTRACTED | | | BASELINE | | | | EXPANDED |

All of the sizes of insert listed above represent a single thumb or finger and all have the same outer diameter so that they are all interchangeable with same ball hole size of one or more bowling balls. The insert elastomers of portions 4, 8/8*a*, 16 or combination of the elastomers used to form portions 4, 8/8*a*, 16 making up a single unit insert or piece of the set of such units are cured at room temperature. After the elastomeric construction is fully cured, as determined by its non-tacky solid consistency, it is then removed from the containment mold as a single, unitary solid piece. Removal of the dental stone model from the molded elastomeric unit creates the anatomically configured cavity 5, 17.

Removal of a conventional surgical rubber obturator (not shown) from the threaded aperture 1, 13 centrally located in the round plate 3, 15 which is now fused to the bottom end 2, 14 of the insert creates a communication between the hollow anatomically configured cavity 5, 17 and the external surface of the bottom end 2, 14 of the insert through the threaded aperture 1, 13. As further explained hereafter, the wider diameter portions 8*a*, 20 and reduced diameter portions 4, 16 of corresponding insert 100, 200 are completed by removal of polyethylene sheeting and waxed paper from the outer surface of the insert; and the interlocking projection 9, 19 is defined in size, shape and location on the insert outer surface at a point 42, 43 where the diameter change occurs from wider diameter outer portions 8*a*, 20 to reduced diameter central portions 4,16, due to the out-pocketing (increased circumference area) of the containment mold.

The insert is then ready to be placed into the appropriate drilled hole 33, 36 of the bowling ball 39. The inner diameter of the bowling ball holes being substantially equal to the outer diameter of the insert's wider diameter portions 8*a*, 20. A detent groove 32, 35 ideally extends 360° around the inner wall of the hole 33, 36 to a depth and width corresponding in radius and configuration to that of the interlocking projection 9, 19 of the insert and the groove 32, 35 further located at a distance below the surface of the ball equal to the distance of the interlocking projection 9, 19 location below the plane A-A' or B-B' of the outer end 11, 21 of the insert 100, 200, so that the detenting engagement can occur between the groove 32, 35 and the projection 9, 19. It is preferred that groove 32, 35 have a 1/16 to 1/8 inch radius and that projection 9, 19 also have a 1/16 to 1/8 inch radius to produce a secure and stable connection (together with the snug press fit between the wider diameter portion 8*a*, 20 of the insert and annular outermost end of the inner wall of the ball hole 33, 36) of the insert inside the bowling ball hole 33, 36.

The size of the wider diameter portion 8*a*, 20 of all the individual insert units of the plurality making up a set of multi-sized inserts for a finger or thumb determines what size drill hole 33, 36 a drillmaster of a pro shop must place in the ball 39, and is the same size for all individual insert units of the plurality for a specific finger or thumb. However, because the insert is custom made to the specific finger(s) or thumb of any bowler, the outside diameter of outwardly directed cylindrical portion 8*a*, 20 of the insert and the i.d.. of its corresponding ball hole 33, 36 can vary over a reasonable range to accommodate the size of any bowler's digits.

Therefore, most commonly inserts 100, 200 will have overall dimensions in a range of approximately 1 3/16 inch to approximately 1 3/4 inch diameter, taken at the widest portions 8*a*, 20, with a most common diameter of about 1 3/8 inch for the thumb and of about 1 1/8 inch for the finger. Inserts 100, 200 have an overall length in a range of approximately 1 5/8 inch to 2 3/4 inch, with the usual length being 1 5/8 inch for a finger using the commonly known "finger tip grip" drilling style, and a common length of 2 3/4 inch for a thumb insert. These ranges for length refer to the entire insert construction, including portions 3, 4, and 8/8*a* of insert 100 and portions 15, 16 and 20 of insert 200.

The hollow anatomically configured cavity 5, 17 size is unique to every finger and thumb and is varied in internal diameter size according to the waxing additions or subtractions done in the perimeter expansion technique. The round threaded aperture 1, 13 centrally located in the round plate 3, 15 permits the hollow anatomically configured cavity 5, 17 to communicate with the inside of the bowling ball hole 33, 36 to provide insert with a vacuum-release function upon finger insertion and removal from the insert. Aperture 1,13 also provides a coupling site for the threaded end 25 of extraction rod 23. The threaded aperture 1, 13 preferably measures about 1/4 inch diameter, but the size can be altered with a reasonable range, as long as the it is not so small as to interfere with the vacuum-release function, and so long as the size is matched to any extraction tool to be used with the insert.

In use of the new adhesive-free inserts extraction and insertion of the inserts and thus interchangeability is readily accomplished by use of two smooth cylindrical solid rods 23, 26 each about six inches long and approximately 5/16 inch in diameter. One rod 23 has an end 24 provided with external threads of a size appropriate to engage the threads on the internally threaded aperture 1, 13 of corresponding insert 100, 200. The other rod 26 has a wedge-shaped end 29 with an approximately 20° angle, indicated at element number 28 in FIG. 11, extending a distance of about 3/4 inch from end 29 toward the opposite end of rod 26.

Extraction of the insert is accomplished by screwing the threaded end 25 of rod 23 into the threaded aperture 1, 13 of the round plate 3, 15. With this threaded coupling secured, the wedged end 29 of the second rod 26 is inserted between the inner wall of the ball hole 33, 36 and the outer surface of the wider diameter portion 8*a*, 20 of the insert and pressed into the ball hole 33, 36 to the level of the interlocking projection 9, 19 until the interlocking projection 9, 19 is touched by the tip 29 of the wedge 28. Then the wedged rod 26 is firmly pressed toward the threaded rod 23 to pull the projection 9, 19 out of the groove 32, 35 of the ball hole, to thereby disengage the insert stabilization mechanism shown in FIG. 16.

The two rods 23, 26 are pressed together by a firm grip and are then lifted out of the ball hole 33, 36, easily removing by pulling the insert from the ball hole 33, 36 with end 24 of rod 23 threadably connected to the insert at threaded aperture 1,13. For insertion of the insert into a ball hole 33, 36 the aforementioned procedure is reversed, easily sliding the reduced diameter portion 6, 18 bottom (inwardly directed) end 2, 14 of the insert 100, 200 into the ball hole 33, 36. Although this is the preferred method for insert and removal of the insert from a bowling ball hole, it is conceivable that other useful alternative methods are available or will be developed. For example, another device may be conceived which will permit the bowler to grasp and pull the insert from the hole.

Production of the present insert 100, 200 is accomplished according to the principles of the method described herein and in the above-referenced copending patents, with further modifications, as explained hereafter.

Prior to placing the fully cured, rock hard dental stone, positive finger or thumb model into the containment mold, a ring shaped centering device made of an elastomer which is fusion incompatible to the elastomers of insert components 4, 8, 16, for example, is placed in the bottom of the containment mold. This provides both stability and coaxial alignment of the positive finger or thumb mold with the containment mold.

The containment mold is then lined with polyethylene sheeting (with a thickness in the range of approximately 1/32 inch to approximately 1/16 inch) from the level of a ring shaped centering device, which is provided to support and level the mold, up to the level of the out-pocket of the containment mold. The area of the inner wall of the containment mold covered by polyethylene sheeting represents the reduced diameter portion 6, 18. The definition of cylindrical portion 6, 18 is transferred by molding to the final insert product. A thin coating of known separator, such as but not limited to, zinc stearate or petroleum compound soap is applied to the out-pocketed area of the containment mold. A layer of waxed paper is then placed into the containment mold, lining the inner wall thereof from the end opposite to the end of the centering ring down into the containment mold until it touches and is contiguous with the polyethylene sheeting. An opening is left in the waxed paper, which opening is formed to the size and shape of the entrance opening of the out-pocket, in order to overlay the entrance of the out-pocket of the containment mold which will form by molding the detenting projection 9, 19 of the final insert. The area of the inner wall of the containment mold covered by waxed paper defines the wider diameter portion 8*a*, 20 which is transferred by molding to the final insert.

A further acceptable modification of the present method is that the positive dental stone finger or thumb model is transformed into a plurality of units of the insert by the perimeter expansion technique described earlier in this preferred embodiment section of this patent using a substance such as but not limited to, molten beeswax. The dental stone positive finger or thumb molds, each with its own particular coating thickness of beeswax, are introduced into their respective containment molds with the outer end of the positive digit mold firmly set into a centering ring, and an elastomer for forming portions 8/8*a*, 16 such as, but not limited to, a room temperature vulcanizing ("RTV") liquid rubber polyurethane ("hard polyurethane") with a preferred Shore durameter hardness of 80 (an acceptable range being about 65 to about 90), or an external prosthetic quality silicone ("hard silicone") with a preferred Shore durameter hardness of 70 (acceptable range of about 30 to about 80) is then placed into the containment mold covering the positive finger or thumb mold at its outer end filling the containment mold to a level up to the greatest circumference of the positive finger or thumb model.

The elastomer of the first portion poured 8/8*a*, 16 is allowed to begin setting as determined by the liquid consistency of the elastomer becoming firmer (a time variable event depending on what kind of elastomer is used). Then a second elastomer used in portion 4, such as, but not limited to, an RTV liquid rubber polyurethane ("soft polyurethane") with a preferred Shore durameter hardness of 30 (acceptable range from about 30 to about 45) or an external prosthetic quality silicone ("soft silicone") with a Shore durameter hardness of 05 (acceptable range from about 05 to about 30) is placed into the containment mold to completely cover the remainder of the exposed, elastomer-free positive digit mold to a level approximately ⅛ inch beyond the bottom end of the positive finger or thumb mold.

Round plate 3, 15 is formed of material such as, but not limited to hard, rigid plastic or aluminum, with the threaded aperture 1, 13 protected by insertion of surgical tubing or similar substance which is fusion incompatible to the elastomers used in portions 4, 8/8*a*, 16. The plate 3, 15 is then introduced into the end of the containment mold closest to the bottom end of the positive finger or thumb mold in such manner that the long axis of the positive digit mold is coaxial and concentric with the central axis of the threaded aperture 1, 13 of the round plate 3, 15, and the end of the surgical tubing rests directly on the bottom end tip of the positive digit mold. The mold assembly is allowed to cure for about 48 hours at room temperature or until fully set as determined by the non-tacky, completely firm condition of the ensemble.

The solid, composite unit formed of the two elastomeric components 4, 8/8*a* (which have remained unblended, but fused together end to end at the plane of fusion 7), the fused round plate 3, 15 with surgical tubing, the adherent wax paper and polyethylene sheeting, and the positive finger or thumb mold, is now removed from the containment mold. This is accomplished by first pulling out the surgical tubing, opening the bi-valved containment mold and directly pushing the dental stone positive finger or thumb mold out of the anatomically configured digit cavity 5, 17. The detenting projection 9, 19 is then easily removed from the out-pocket of the containment mold and the waxed paper and polyethylene sheeting are easily peeled from the outer surface of the wider diameter portion 8*a*, 20 and reduced diameter portion 6, 1 of the insert.

The resulting bowling ball insert is a plurality of units of cylindrical structure with a wider diameter portion 8*a* 20 at the outer end, 11, 21 abruptly changing, step-wise, to a reduced diameter, central cylindrical portion 6, 18. A projection 9, 19 is disposed on the outer surface of the wider diameter portion 8*a* 20 of the insert. The reduced diameter of the central portion 6, 18 is the same diameter as the inwardly directed round plate 3,15, so that the smaller diameter wall extends all the way from the plane of its intersection and attachment to wider portion 8*a* 20 to the bottom end 2, 14 of the insert. As part of the molding process round plates 3, 15 are fused end to end to the respective central cylindrical elastomeric portions 4,16 of the insert. The insert thus formed is composed of one or more elastomers for portions 4, 8/8*a* that are likewise fused together, but not intermixed.

The resulting plurality of inserts formed for an individual bowler provide interchangeable units to be used in one or more bowling balls, with the interchangeability under the complete control of the bowler. The plurality of inserts for an individual bowler also permit the size of finger or thumb cavity 5, 17 to both increase and decrease commensurate with the expansion and contraction of the bowler's finger or thumb. A variable hardness and friction differential which is dependent upon the elastomeric components 4, 8/8*a*, 16 of the insert, the harder elastomeric components 8/8*a*, 16 serve to increase the durability of the insert and increase the extraction speed of the finger or thumb from the bowling ball hole 33, 36. All unit inserts of the plurality of the inserts possess a true and accurate anatomical copy of the bowler's finger and thumb. In this manner, by anatomically correctly adjusting for digit swelling and shrinkage, a standardization of "feeling" is achieved. Because the new inserts are custom made for a particularly bowler they are truly interchangeable from ball to ball and provide a consistency of "feel" during bowling that has never before been achieved. This consistency is also provided from insert to insert within the same ball.

Therefore, the present invention is intended to, and does, directly address the problems of both the expansion and contraction of bowler's fingers and thumbs. It does this by: (1) accommodation of any finger abnormality, deformity, such as a callous, (as indicated for example at "D" in FIG. 1), which ordinarily would make the discomforting effects of swelling worse; (2) providing the bowler with the ability of rapid and easy insert exchange by the bowler himself or herself at any time; (3) adhesive-free stabilization of any insert regardless of its chemical composition (including silicones, polyurethane, syntheticresinousfluorine-containing polymers such as those sold under the registered trademark, "TEFLON", vinyl, etc); (4) adjustability of finger extraction speeds from the inserts by use of different elastomers; and (5) providing exceptional insert durability, by using single or multiple elastomeric combinations within the same insert or multiple inserts; and comfort of use due to custom fit, adjustable fit and the materials selected.

To further explain, the present invention is plurality of different sizes of deformable, interchangeable, self-locking, adhesive free inserts, each of variable composition, hardness and softness, for bowling balls. The new inserts are sized to fit within a drilled finger hole of one or more balls, and are anatomically configured to receive a bowler's finger or thumb placed within the insert. The new inserts include a semi-solid cylinder of one or more deformable, resilient elastomers of varying composition, hardness and softness, variable for any insert of the plurality. The outer surface of the cylinder has two different diameters and a outwardly directed end and an inwardly directed end, relative to the interior of the bowling ball in which the inserts are disposed in normal use position. The outer end of the cylinder has a larger diameter and the bottom end of the cylinder has a smaller diameter, both diameter sizes being contiguous at a variable point along the long axis length of the cylinder. At least one integral projection preferably extends from the outer side wall of the larger diameter outer portion of the cylinder. The projection is disposed in interrupted or uninterrupted fashion 360° around the larger portion of the cylindrical side wall, and is of selectively variable size, number and shape. Preferably the bottom side of the projection(s) defines the point of contiguous end to end juncture of the larger and smaller diameter cylinder portions.

The cylinder has a solid circular plate with an outwardly directed end and an inwardly directed or bottom end (directed toward the bottom of the bowling ball hole in normal use), the outwardly directed end of the plate (relative to its normal use position in a bowling ball hole) being fused coaxially and end to end with the bottom (inwardly directed) end of the central cylindrical portion of the insert. The plate has an outer diameter equal to or smaller than the diameter of central cylindrical portion. The round plate has an aperture or through-hole, preferably disposed centrally on the plate and coaxially with the central longitudinal axis of the insert outer and central cylindrical portions of the insert.

A kit provides a plurality of multiple sizes of the insert customized for the individual bowler and including two tools which are preferably smooth, cylindrical rods of variable length. One of the rods has a wedge shaped bottom end and the other rod has a threaded end adapted for threadable connection to the aperture in the insert round plate.

The insert may be formed of a deformable, resilient, elastomer, such as but not limited to, polyurethane, silicone, TEFLON and vinyl (or other useful alternatives, known, or not yet developed) having a range of hardness and softness, wherein only one elastomer within the range of hardness and softness used makes up the entire structure of the insert. Alternatively, more than one elastomer within the range of hardness and softness used can be combined to make up the insert and can be mixed (blended) or unblended and molded into any anatomically correct configuration for a particular bowler, to achieve the final structure of the insert. Each individual deformable, resilient, elastomer in the acceptable range of hardness and softness has a related individual coefficient of friction.

The importance of the friction differential offered by the various selectable elastomers lies in the fact that the friction and hardness characteristics of the multiple elastomers allow function specificity for different parts of the same grip. This means, for the individual bowler, less strain in gripping the ball and less inflammation of tendons because the deep end of the grip is composed of a soft, high friction component. The high friction prevents slippage and therefore makes it easier for the bowler to grip the ball with less force.

When, using the new inserts, as the bowler's grip is released, the hard, low friction component of the upper end of the insert helps the thumb exit the ball faster, actually increasing the slide as the thumb comes out of the ball hole, thus helping to prevent "hang-ups". Despite part of the grip having increased hardness, this hardness is not at all perceived by the bowler because the bowler's finger rests easily in its own anatomically shaped cavity in the grip. Thus, there are no points of increased pressure on the digit, allowing maximum comfort, minimizing distractions, and letting the bowler concentrate and perform optimally.

As an alternative to the various constructions described in detail herein, and as disclosed in a copending application referred to above, the insert can be formed of more than one elastomer, and with an anatomically correct digit cavity, but with the fusion plane(s) of the multiple elastomers being longitudinal with respect to the long axis of the insert, as opposed to transverse, as described above. In this manner, as may be preferred for some conditions and some bowlers, different elastomers can be used on the front and the back of the thumb of the bowler, rather than at the end and the base of the thumb, to suit individual circumstances.

A set of the new inserts has an inner hollow cavity in every different unit or insert size of the plurality, wherein the inner hollow space is configured to the same anatomical shape of a finger or thumb, except a different external size thereof. The hollow space is coaxial with the insert generally and has an outer and a bottom end, the outer end having a central opening to receive the bowler's finger, and the bottom end having a central, circular opening coaxial with the threaded aperture of the round plate, permitting the anatomically configured digit cavity to be in communication with the bottom (inwardly directed) surface of the round plate.

As an alternative to the above-described structure for the insert, the central cylinder of the insert can be fused en face to the outwardly directed end of a round plate, as previously stated, but the round plate can instead be formed of a substance such as, but not limited to, a metal or plastic.

a solid cylinder having a larger diameter outer end wherein the size of the larger diameter is equal to the size of a drilled hole of a bowling ball, and a smaller diameter bottom end wherein the size of the smaller diameter is less than the size of the same drilled bowling ball hole, and further having one or more solid, interrupted or uninterrupted projections which are part of the larger diameter, configured to a groove of variable shape in the inner wall surface of the same drilled hole of a bowling ball, wherein, the equal size of the larger diameter of the solid cylinder and drilled hole of the bowling ball plus the precise configuration of the projection(s) of the larger diameter of the solid cylinder to a groove in the inner wall surface of the same drilled bowling ball hole provide a self-locking press fitting of the insert in the drilled hole of a bowling ball eliminating the need for an adhesive and allowing interchangeability of various unit sizes of the plurality into drilled holes of the same size in one or multiple bowling balls;

two unattached, separate smooth cylindrical rods formed of a substance, such as but not limited to, a metal, or plastic, wherein the one rod has a threaded portion disposed at its bottom end of the same shape and thread size as the threaded aperture of the round plate, and the other rod having a wedge shape disposed at its bottom end.

To further explain, the invention includes the method of producing an anatomically configured finger insert for the drilled hole of a bowling ball, which insert is standardized for the individual user which allows unlimited replication of all the finger inserts of any individual bowler to be standardized for standardized "feel" with which a bowling ball is gripped. Although variations are conceivable, the preferred embodiment of the new method entails the steps of:

applying a high purity silicone rubber in its totally mixed, pre-cured state to a finger or thumb;

allowing the high purity silicone rubber to fully cure while on the finger or thumb;

removing the cured high purity silicone rubber en bloc from the finger or thumb, which by definition, now contains a precise anatomically configured mold of the finger or thumb;

filling the anatomically configured mold with a slurry of dental stone modeling compound;

allowing the slurry of dental stone modeling compound to cure and then removing the hard, cured dental stone from the anatomically configured mold;

placing the cured dental stone model into a structured cylindrical containment mold containing a round plate with a centrally threaded aperture at the bottom end of the containment mold;

filling the containment mold with one or more elastomers and allowing the elastomers to cure at room temperature;

after the elastomer(s) are fully cured, removing the elastomer construct, with the round plate fused to it, and the dental stone model from the containment mold;

removing the dental stone model from the inside of the elastomer construct, thereby producing a single unit size of the plurality of the insert formed of one or more elastomers cured in an already blended state, or unblended, but fused together in various configurations, as described in the copending application referred to above, and incorporating by fusion during the molding process a round plate of variable thickness with a centrally disposed threaded aperture at the bottom end of the unit, and a hollow anatomically configured cavity size copied for a specific finger or thumb, the hollow anatomically configured cavity communicating with the environment through an opening at the outer end of the anatomically configured cavity and through the threaded aperture of the round plate which communicates the hollow anatomically configured cavity with the external surface of the bottom end of the insert which is one and the same as the bottom end of the round plate.

The preferred cavity perimeter (i.d.) alteration method for upsizing and downsizing the baseline or starting unit size of the plurality of the insert to produce the multiple sized set of a plurality of inserts includes upsizing from the baseline size by applying a substance such as but not limited to, molten beeswax (for example, with a syringe), to the external surface of the baseline size dental stone model. The mold is extended from any physical prominence or prominent deformity (or even a long fingernail) to the outer end of the dental stone model in uninterrupted fashion to create mold-induced "space channel(s)" or anatomical adaptation spaces in all unit sizes of the plurality. The dental stone model with its "space channel(s)" is placed into a molten beeswax bath for one second, allowing the molten beeswax to totally cover the dental stone and then to harden into one solid mass. By this process the thickness of the total covering of beeswax expands the perimeter (o.d.) of the baseline (dental stone unit) size of the plurality of inserts to be formed, making the waxed form the next size larger unit of the plurality. This is accomplished while still reproducing the same anatomical internal insert shape as is in the baseline unit.

To produce further upsized units, additional coatings of molten beeswax are applied, each additional coating of beeswax producing the next increasing size in diameter of each insert unit size of the plurality of inserts in a set.

Downsizing from the baseline size is accomplished by applying molten beeswax, for example, with a syringe or brush, to the internal surface of the mold of the finger or thumb insert produced in high purity silicone. The beeswax or other coating is allowed to harden, then a slurry of dental stone is added to the waxed cavity of the high purity silicone. The slurry of dental stone is permitted to harden, creating a dental stone model with the same anatomical shape as the baseline unit, but with a smaller internal diameter than the baseline unit, by an amount equal to the thickness of one coating of beeswax. To produce further downsized units, additional coatings of molten beeswax are applied over those already in place on the inner surface of the high purity silicone mold and then dental stone slurry are added and allowed to harden after each additional coating of beeswax. The number of upsized and downsized dental stone models placed into the containment molds and bathed in various elastomers, produce, after the elastomers cure and the dental stone models are removed, all the multiple sized units of the plurality of the insert in a set.

The present insert represents finger and thumb hole inserts that are selectively removably placed into the drilled hole of a bowling ball and stabilized in place using a press fit technique and a male-female interdigitation or detenting engagement of a projection from the insert into a groove in the inner wall of the drilled hole of the bowling ball, and therefore the stabilization of the insert in the drilled hole of the bowling ball is without the use of an adhesive or glue.

Because some bowling organizations have instituted rules that control professional bowling competition and the equipment which is permitted in such competitions, and because of the radical design of the present invention, it is conceivable that an alternative embodiment will be necessary which can be permanently fixed in the bowling ball hole, such as by adhesives, for example, in order to meet requirements of such organizations. Despite the fact that the present invention is designed to be adhesive-free and has the advantage of interchangeability predicated on the adhesive free feature, because of limitations found in previously known bowling ball inserts, some bowling organizations may not allow the use of adhesive-free bowling ball inserts, as described above, during competition bowling. Therefore, to render the present invention conformable to the rules of such organizations, so that the invention can be used in all competition bowling, a "glue-in" embodiment is conceived and described hereafter.

Because most bowling balls are formed of polyurethane the present invention, when formed of polyurethane can be easily glued into the ball hole using a known cyanoacrylate adhesive. However, silicone and Teflon materials are incompatible with polyurethane; i.e. they cannot be so simply and directly glued together. Thus, it has become necessary to develop a technique, as described hereafter, that will allow the fusion (gluing-in) of a new insert formed of silicone or TEFLON material into a polyurethane ball.

It is well known that it is difficult, if not impossible, to glue a silicone insert into a bowling ball comprised of polyurethane because the two substances are fusion incompatible and will not bond one to the other, even if a known silicone adhesive or a cyanoacrylate bonding substance is used. However, it is possible to essentially produce a secure state of a silicone insert within a polyurethane bowling ball hole by using a bridging technique which makes use of, a flexible material, preferably a fine, thin fabric with very small weave openings, such as, but not limited to, natural fiber weaves (e.g. cotton or woolen weaves) and polyesters or synthetic weaves, such as that fabric presently commercially available under the name DACRON (a registered trademark of E.I. DuPont DeNemours and Company). The bridging material is allowed to fuse on one side to the exterior surface of the insert (e.g. of silicone), on the side walls and or bottom surface thereof, effectively becoming an enveloping wrapper completely stabilized on one side by fusion with silicone. The material-enveloped silicone insert is positioned in an appropriately drilled polyurethane bowling ball hole with an inner diameter substantially equal to the outer diameter of the material-enveloped silicone insert.

Then, a bonding agent, such as but not limited to cyanoacrylate, is applied to both the polyurethane surface of the inner wall of the drilled ball hole and the other un-fused side of the fabric material. Cyanoacrylate readily bonds to polyurethane and DACRON material or other fabric, thus acting as a fusion "bridge" between two fusion incompatible substances such as silicone and polyurethane and thus creating a secured state for the insert in the ball hole. Although the above-described bridging technique would suffice to secure a particular one of the described inserts into a bowling ball hole, this method would not be suitable for use if the bowler wishes to be able to quickly remove and replace the insert with another, as could occur during a game. Removal of an insert secured in this fashion could cause damage to the insert and render it unfit for further use. However, as described, in some circumstances this "glue in" alternative might be required by rules, or even preferred by some bowlers, and can be an acceptable substitute for securing the new insert by the preferred detenting mechanism described above.

In appearance and construction, this "glue in" embodiment would be very similar to the versions illustrated in the figures herein, except that detenting elements 9, 19 would not be necessary and the outer diameter of the inserts would be adjusted to accommodate the adhesive and the bridging fabric. It would not be necessary to provide a wider diameter of the insert at the outwardly directed end thereof, because the securement of the insert in the ball hole would be by adhesive rather than fit and detent mechanism. Thus, in this alternative embodiment the outer cylindrical side wall of the insert can be the same diameter over the entire length of the insert and the internal aspects, and elastomeric material construction can otherwise be identical those the embodiments 100, 200 described and shown.

Throughout the above, and in the claims below it is to be understood that the use of the term "finger" will be used interchangeable with and will mean "digits", so as to not exclude consideration of the user's thumb. Conceivably, there may be a few highly skilled individuals who can bowl with their feet. In such circumstance, the use of the word "finger" or "digit" will also include "toe", as certainly the present invention will be useful for such individuals in order to better adapt a bowling ball to suit their particular needs. The separate references to the figures regarding "thumb" and "finger" are for purposes of illustration and to make it clear that the invention applies to a thumb hole insert for a bowling ball, as well as to a literal finger hole insert. It should also be understood that partial and even full hand amputees can also make use of the invention, in view of its being custom fit to each individual bowler.

In view of the foregoing, it will be seen that the several objects of the invention are achieved and other advantages are attained. Although the foregoing includes a description of the best mode contemplated for carrying out the invention, various modifications are conceivable.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. The combination of a bowling ball and a customized, anatomically correct insert for the bowling ball hole, the insert comprising:

a main body portion having a first end and a second end, an outer portion having a first end and a second end, the first end being flush with the surface of a bowling ball with which the insert is intended to be used, and the second end being connected to the first end of the main body portion of the insert, the bowling ball having a finger hole, the outer portion of the insert being positioned in the bowling ball finger hole adjacent the surface of the bowling ball when the insert is positioned for use in the bowling ball finger hole, and the outer portion of the insert having a greatest external dimension substantially equal to an internal dimension of the bowling ball finger hole, so as to be capable of being press-fit into the bowling ball finger hole, yet not being so large as to be subject to becoming so tightly stuck that it cannot be selectively removed by the bowler from the bowling ball finger hole;

the main body portion of the insert having an outer side wall with a greatest external dimension less than a greatest external dimension of the outer portion of the insert so that an air space remains between the outer side wall of the central portion and a portion of the bowling ball defining the bowling ball finger hole; and the main body portion of the insert and the outer portion of the insert having formed therein an anatomically correct cavity for receiving a finger of a bowler for whom the insert is custom-made;

further comprising a plate connected coaxially to the second end of the main body portion and positioned substantially at a bottom of the bowling ball finger hole when the insert is disposed for use in the bowling ball finger hole;

wherein the plate has an aperture formed therein, the aperture in the plate being internally threaded to thereby permit engagement of the aperture with corresponding threads on the external surface of a tool, to facilitate insertion into and removal of the insert from the bowling ball finger hole by use of the tool.

2. The insert of claim 1, wherein the second end of the outer portion comprises an integral inwardly extending portion, which has the same greatest external dimension as that of the main body portion and is connected coaxially to the first end of the main body portion.

3. The insert of claim 1, wherein the plate is molded to the second end of the main body portion.

4. The insert of claim 1, wherein the second end of the main body portion of the insert is provided with a through-hole disposed in alignment with the aperture in the plate.

5. The insert of claim 1, wherein the outer portion and the main body portion are integral with one another and formed of the same elastomeric material.

6. The insert of claim 1, wherein the outer portion and the main body portion are formed of different elastomeric materials.

7. The insert of claim 1, wherein the plate is formed of a material selected from a non-elastomeric material.

8. The insert of claim 1, wherein an exterior side wall of each of the main body portion and the outer portion are generally cylindrical.

9. The insert of claim 1, wherein the plate is round.

10. The insert of claim 1, wherein the plate has an outer perimeter of the same size and shape as the external side wall of the main body portion.

11. The insert of claim 1, and further comprising structure for securing the insert within the bowling ball finger hole.

12. The insert of claim 11, wherein the structure for securing the insert within the bowling ball hole is formed on the external surface of the outer portion of the insert.

13. The insert of claim 11, wherein the structure for securing the insert within the bowling finger ball hole is a detenting mechanism, which interacts with a corresponding detent mechanism formed within the bowling ball hole to thereby provide selective releasable securing of the insert within the bowling ball hole.

14. The insert of claim 13, wherein the detenting mechanism is a projection on the external side wall of the insert at the widest dimension thereof and disposed to engage a correspondingly sized and shaped mating area on the inside of the bowling ball finger hole in which the insert is used when in normal use position, with the outmost end of the insert being substantially flush with the surface of the bowing ball.

15. The insert of claim 1 wherein the insert comprises more than one elastomeric material.

16. The insert of claim 1 wherein the different portions of the insert are formed of different elastomeric materials.

17. The insert of claim 1, wherein the outer portion is formed of an elastomeric material having a Shore durameter hardness in the range of about 50 to about 90.

18. The insert of claim 17, wherein the outer portion is formed of an elastomeric material which is a polyurethane having a Shore durameter hardness in the range of about 65 to about 90.

19. The insert of claim 18, wherein the polyurethane of which the outer portion is formed has a Shore durameter hardness of about 80.

20. The insert of claim 19, wherein the outer portion is formed of an elastomeric material which is a silicone material having a Shore durameter hardness in the range of about 50 to about 70.

21. The insert of claim 20, wherein the silicone material of which the outer portion is formed has a Shore durameter hardness of about 70.

22. The insert of claim 1, wherein the main body portion is formed of an elastomeric material having a Shore durameter hardness in the range of about 30 to about 90.

23. The insert of claim 22, wherein the elastomeric material of which the main body portion is formed is a polyurethane having a Shore durameter hardness of about 65 to about 90.

24. The insert of claim 23, wherein the polyurethane has a Shore durameter hardness of about 80.

25. The insert of claim 24, wherein the elastomeric material of which the main body portion is formed is a silicone material having a Shore durameter hardness of about 05 to about 80.

26. The insert of claim 25, wherein the silicone material has a Shore durameter hardness of about 70.

27. The combination of a bowling ball and a customized kit of anatomically correct inserts for the finger holes of the bowling ball, the kit comprising a plurality of inserts custom made for one or more digits of a bowler using the kit, each of the inserts comprising:

a main body portion having a first end and a second end;

an outer portion having a first end and a second end, the first end being flush with the surface of a bowling ball with which the insert is intended to be used, and the second end being connected to the first end of the main body portion of the insert, the bowling ball having a finger hole, the outer portion of the insert being positioned in one of the bowling ball holes adjacent the surface of the bowling ball when the insert is positioned for use in a bowling ball finger hole, and the outer portion of the insert having a greatest external dimension substantially equal to the internal dimension of the bowling ball finger hole, so as to be capable of being press-fit into the bowling ball finger hole, yet not being so large as to be subject to becoming so tightly stuck that it cannot be selectively removed by the bowler from the bowling ball finger hole;

the main body portion of the insert having an outer side wall with a greatest external dimension less than a greatest external dimension of the outer portion of the insert so that an air space remains between the outer side wall of the central portion and a portion of the bowling ball defining the bowling ball finger hole; and the main body portion and the outer portion of the insert having formed therein an anatomically correct cavity for receiving a finger of the bowler for whom the insert is custom-made;

further comprising at least one tool to facilitate extraction of an insert of the kit from a bowling ball finger hole and insertion of an insert from the kit into the bowling ball finger hole;

wherein the plate includes a threaded aperture and the at least one tool includes a rod having threads at one end, which threads are sized appropriately for interconnection with the threaded aperture, to thereby permit the bowler for whom the inserts were custom made to quickly and easily remove an insert of the kit from the bowling ball finger hole without the assistance of another person.

28. The kit of claim 27, wherein the kit comprises a set of a plurality of inserts of different i.d. sizes, each of the plurality of inserts being anatomically correct, for a given digit of a bowler for which the inserts of the kit were custom made, the plurality of inserts all having an outer portion with the same o.d., to thereby permit each one of the plurality of inserts to fit into the same hole in a bowling ball, yet to accommodate increasing and decreasing changes in the size of the bowler's digit while still being anatomically correct for the particular digit of the bowler.

29. The kit of claim 28, and further including a specific set of a plurality of inserts of various sizes for each of one or more digits of the bowler.

30. The kit of claim 29, wherein a set of inserts of various sizes is provided for the thumb and at least one finger of the bowler.

31. The kit of claim 30, wherein each set includes at least two sizes of inserts for each digit for which a plurality of inserts is provided.

32. The kit of claim 31, wherein each set includes insert anatomical digit cavity sizes which include a baseline size and sizes greater and lesser than the baseline size.

33. The kit of claim 27, wherein each insert of the kit includes structure for securing the insert in the bowling ball finger hole, and wherein the at least one tool includes a disengagement tool, to thereby permit the bowler for whom the inserts were custom made to disengage the structure for securing the insert in the bowling ball.

34. The kit of claim 33, wherein the structure for securing the insert in the bowling ball finger hole is a detenting mechanism and the disengagement tool is a rod having a wedge-shaped end, to permit the bowler to place the wedge-shaped end of the rod between the bowling ball and the insert outer portion and thereby easily disengage the structure for securing the insert in the bowling ball finger hole.

35. The insert of claim 1, and further wherein the insert has a piece of flexible fabric material having two opposed sides attached on one of the two opposed sides to the exterior of the anatomically correct insert, the flexible fabric material having an adhesive bonding agent on the other side thereof, to thereby permit the fabric to act as a bridge between and permit adhesion of the anatomically correct insert to the interior of the bowling ball finger hole.

36. The kit of claim 27, and further comprising a piece of flexible fabric material having two opposed sides attached on one of the two opposed sides to the exterior of the anatomically correct insert, and an adhesive bonding agent applied to the other side of the flexible fabric material, to thereby permit the fabric to act as a bridge between and permit adhesion of the anatomically correct insert to the interior of the bowling ball finger hole.

* * * * *